US006242397B1

(12) United States Patent
Milio et al.

(10) Patent No.: US 6,242,397 B1
(45) Date of Patent: Jun. 5, 2001

(54) SOAP WRAPPERS

(75) Inventors: Ronald John Milio; John Duncan Wagner, both of Chester (GB)

(73) Assignee: Lever Brothers Co., division of Conopco, Inc., New York, NY (US)

( * ) Notice: Subject to any disclaimer, the term of this patent is extended or adjusted under 35 U.S.C. 154(b) by 0 days.

(21) Appl. No.: 09/533,011

(22) Filed: Mar. 22, 2000

Related U.S. Application Data

(63) Continuation of application No. 09/124,545, filed on Jul. 29, 1998, now Pat. No. 6,048,829.

(30) Foreign Application Priority Data

Aug. 8, 1997 (GB) ..... 9716878

(51) Int. Cl.[7] ..... A61K 7/50
(52) U.S. Cl. ..... 510/140; 510/439
(58) Field of Search ..... 513/140, 439

(56) References Cited

U.S. PATENT DOCUMENTS

| | | | | |
|---|---|---|---|---|
| 1,657,391 | * | 2/1927 | Haney | 87/23 |
| 2,163,228 | * | 3/1939 | Jorling | 87/23 |
| 2,267,310 | * | 1/1941 | Shearer | 252/93 |
| 4,406,364 | * | 9/1983 | Bronander, Jr. | 206/77.1 |
| 4,877,674 | | 10/1989 | Kappes . | |
| 5,098,012 | | 3/1992 | Will . | |

FOREIGN PATENT DOCUMENTS

| | | | |
|---|---|---|---|
| 239340 | * | 9/1987 | (EP) . |
| 1021557 | | 3/1966 | (GB) . |
| 04170569 | | 12/1991 | (JP) . |
| 05-162269 | | 6/1993 | (JP) . |

* cited by examiner

*Primary Examiner*—Necholus Ogden
(74) *Attorney, Agent, or Firm*—Alan A. Bornstein

(57) ABSTRACT

A bar of soap having, wrapped laterally of the bar, around at least a longitudinal extent of the bar, a stiffening member comprising a stiff sheet material having at least respective outer surfaces thereof each provided by a plastics material.

4 Claims, 1 Drawing Sheet

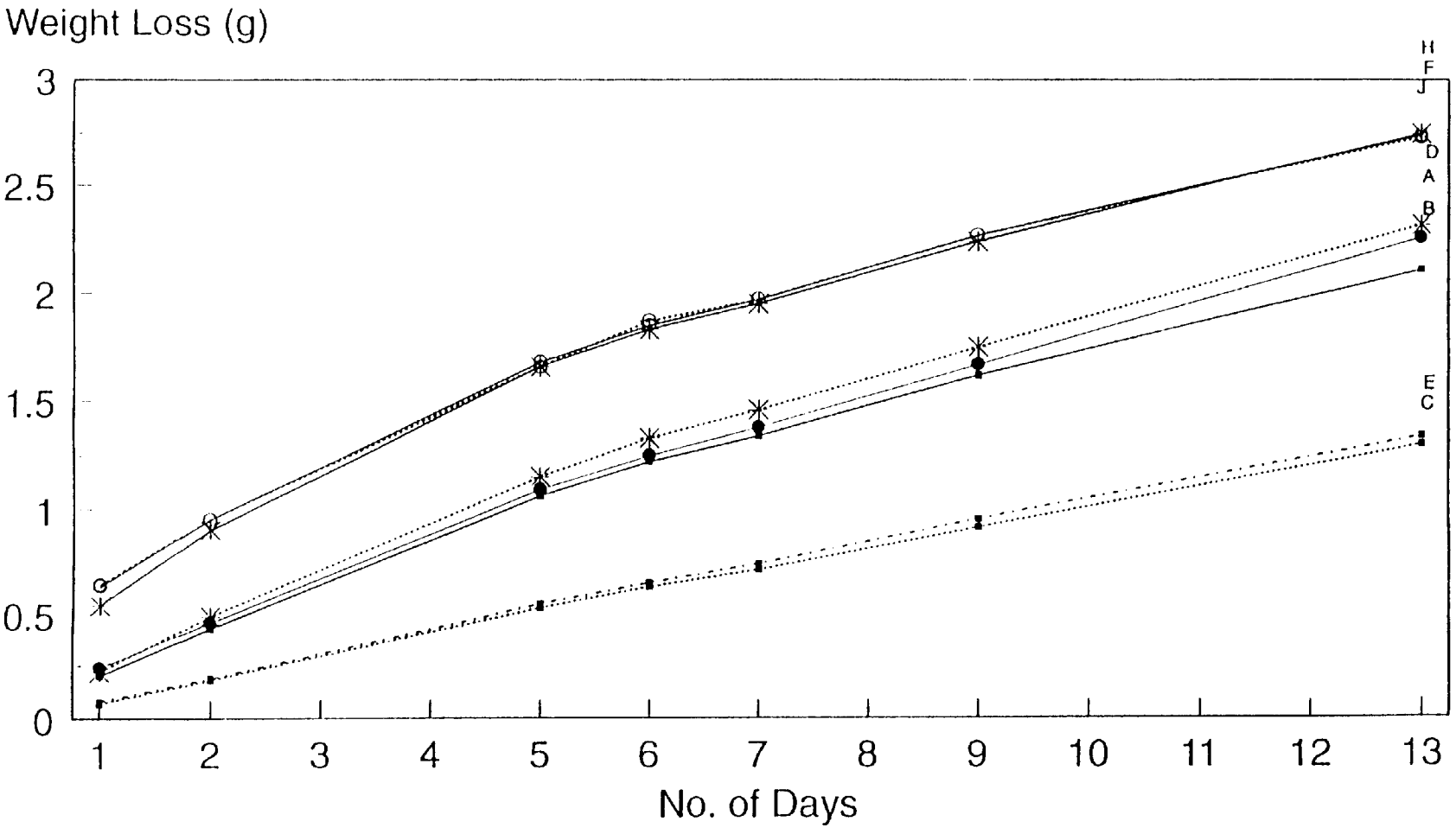
Weight Loss (g)
3
2.5
2
1.5
1
0.5
0
1
2
3
4
5
6
7
8
9
10
11
12
13
No. of Days
H
F
J
D
A
B
E
C

SOAP WRAPPERS

This is a continuation of Ser. No. 09/124,545 filed Jul. 29, 1998, U.S. Pat. No. 6,048,829.

This invention relates to soap wrappers and, in particular, to a bar of soap wrapped by at least a stiffening member and to a package comprising the bar of soap, the stiffening member and a wrapper entirely surrounding each of the bars of soap and the stiffening member.

In the past a considerable effort has been placed into developing special fungicide containing papers and stiffener board for wrapping soap. As cellulose, which is the major constituent of paper, is an excellent growth medium for mould particularly under moist warm conditions, the use of a fungicide (known in the USA as an "antimicotic") is essential in soap packaging to prevent spoilage. These compounds serve as "fungistats"; they prevent the onset of mould growth.

Unfortunately the number of fungicides that can be safely used for soap wrapping are limited at least because some are very toxic to man. In addition moulds can become resistant to fungicides after prolonged exposure which necessitates changing the fungicide about every 7 years. Carbendazim and Thiabendazole have been used in the past but are now ineffective under tropical conditions and a significant amount of development resource has been necessary by the paper makers in developing a suitable second generation fungicide. This has required a long programme of tests and screening, which, after moulds have become resistant again, would need to be repeated if this procedure for avoiding mould growth continues to be adopted.

It is known to use a film of plastics material to wrap soap. In particular, in a known package of a bar of soap, the soap is wrapped by a conventional paper stiffener and the soap and stiffener wrapped entirely by a film wrapper which is a laminated film comprising two layers each of an oriented polypropylene. The concern is however that this approach only addresses the appearance of the bar, which is enhanced by the high gloss of plastics films. It makes no difference to the problem of mould attack as the continued use of a conventional stiffener board will still make the stiffener susceptible to attack.

Mould attack is accelerated by warm moist conditions and as a soap bar contains free water when first wrapped, the wrapper and stiffener are initially very wet. With paper wrappers this equilibrates relatively quickly as water is lost rapidly through the paper and the folded-over, glued ends of the wrapper.

We find that if a bar of soap has, wrapped around at least a longitudinal extent thereof, a stiffening member, at least respective outer surfaces of which are each provided by a plastics material, then mould growth on and within it can be entirely avoided.

Similarly, if, additionally, a wrapper, wrapped around each of the bar of soap and stiffening member, comprises a film material having at least respective surfaces thereof each provided by a plastics material, mould growth on and within it can be entirely eliminated.

Moreover, as shown with reference to the attached graph 1, since only the folded ends of the wrapper provide a route for moisture escape-the rate of water loss is considerably decreased to provide a desired amount of water within the bar. On the other hand the film wrapper of plastics material gives a very effective moisture barrier.

In particular, in microbiological laboratory tests using moulds which are shown to be resistant to Carbendazim both films of plastics material and boards coated with plastics material have been tested for mould attack and both were found to be completely resistant.

Thus, according to one aspect, the present invention provides a bar of soap having, wrapped, laterally of the bar, around at least a longitudinal of the bar, a stiffening member comprising a stiff sheet material having at least respective outer surfaces thereof each provided by a plastics material.

Preferably, the stiffness of the stiffening member is at least 3 Taber Stiffness Units in each of the longitudinal (machine) and transverse (cross) directions, and more preferably at least 8 Taber Stiffness units in at least the machine direction.

The stiffening member preferably has a grammage (weight per unit area) of 100 to 200g/m$^2$, and preferably has a thickness of 50 to 250 $\mu$m, more preferably 160 to 180 $\mu$m.

Indeed, we find that, even with a "double board" stiffener coated with plastics material, fungus did not encroach through the edges.

According to another aspect, the invention provides a package comprising a bar of soap and packaging material, which packaging material comprises a stiffening member wrapped, laterally of the bar, around at least a longitudinal extent of the bar, which stiffening member comprises a stiff sheet material having at least respective outer surfaces thereof each provided by a plastics material; and a wrapper, wrapped around, in a manner such as entirely to surround, each of the bar of soap and stiffening member, which wrapper comprises a film material having at least respective outer surfaces thereof each provided by a plastics material.

At least each outer surface of the stiffening member is preferably provided by a thermoplastics material. For example, the sheet material of the stiffening member may be a laminate having a core layer of a paper board and respective outer layers each comprising a layer of thermoplastics material, preferably each having a respective thickness, independently of one another, of from 5 to 35 $\mu$m. However, more preferably, the entire sheet is of a thermoplastics material, which may contain from 5 to 30%, preferably 10 to 25%, more preferably about 20%, by weight of the total weight of the stiffening member, of a filler or blowing agent, or total of filler and blowing agent. Typically, the filler is an inert inorganic filler such as talc or clay. Such fillers provide improved stiffness.

The thermoplastics material of the stiffening member sheet material is preferably selected from polypropylene, polystyrene, acrylic/butadiene/styrene copolymer and polyethylene terephthalate.

It is especially preferred that the stiff sheet material is free from memory so that it does not unfold from a roll on which it was stored and so that it can be folded around the bar of soap, preferably around the entire peripheral longitudinal surface, of the soap bar, after which the stiffening member will remain in the folded condition so as to define a sleeve surrounding the bar of soap. Preferably, longitudinal ends of the bar of soap are not surrounded by the stiffening member, so that the bar of soap can be easily removed for use.

The wrapper may be a film material comprising a paper core coated on each surface with a plastics material. However, preferably the wrapper is a film material which is entirely of plastics material, more preferably thermoplastics material.

The film material of the wrapper preferably has a thickness of from 5 to 50 $\mu$m.

Preferably the wrapper, when wrapped around the bar of soap and stiffening member, has edge portions in overlapping relationship with one another. This allows those edge portions to be secured to one another. This can be achieved by application of an adhesive between various respective opposite surface regions, for example, by coating the adhesive at various regions of the edge portions, folding the wrapper and applying pressure. However, preferably, edge portions are secured to one another by heat sealing so that at least outer layers of the film material of the wrapper are preferably of heat sealable plastics material. Moreover, the edge portions are preferably kept free of printing material etc.

Thus preferably, the film material of the wrapper comprises at least one layer of a biaxially oriented polypropylene capable of heat sealing. More preferably the film is a laminate of a biaxially oriented polypropylene layer with a low density polyethylene film.

Preferred examples of alternative constructions of the wrapper are:

(a) a laminate of a heat sealable film an internal face of which may bear print material and between which a laminating, for example hot melt, adhesive is applied;

(b) a special BOPP film which is capable of heat sealing; and (c) a laminate of a PET, nylon or low density polyethylene film adhered, for example with a hot melt adhesive, to a heat sealable film.

A package according to the invention containing a soap bar can be produced by a method comprising the steps of:

folding around at least a longitudinal extent of the bar of soap a stiffening member so that the stiffening member is wrapped laterally around the bar;

wrapping each of the bar of soap and stiffening member with a wrapper in a manner such as entirely to surround each of the bar of soap and stiffening member and provide overlapping edge portions of the wrapper; and adhering together, preferably by heat sealing, at least respective parts of the overlapping edge portions to secure the wrapper in position.

The stiffening member is preferably formed by casting a molten film of thermoplastics material such as polypropylene or polystyrene.

Typically a soap wrapping system of a package embodying the invention may comprise:

1. A wrapper which can be entirely of plastics material or of paper coated with plastics material. It is preferred that the finished wrapper should be heat sealable on both sides for high speed machines; however, a hot-melt adhesive can be used for sealing in slower wrapping lines.

2. A stiffener which can be either 100% plastics material, a filled plastics film or paper or board coated on both sides with a plastics material.

Especially preferred examples of both wrappers and stiffeners which can provide a "mould proof" soap packaging are as follows:

Wrapper Materials

1. Biaxially orientated, coextruded polypropylene (BOPP) films 15–35 μm in thickness, surface printed and lacquered with areas of edge portions to be sealed to one another being free of ink and varnish.

2. BOPP films of 15–35 μm thickness, reverse printed and extrusion coated over the ink with 12–35 μm low density polyethylene (LDPE) or linear low density polyethylene (LLDPE), or mixtures thereof. Instead of a homopolymer of LDPE or LLDPE, a copolymer containing each of these can be used for coating. Moreover, such a homopolymer or copolymer may contain additionally from 2–10% ethylene vinyl acetate (EVA) copolymer units, especially in the LDPE to improve sealing.

3. Two or more BOPP films of 10 35 μm thickness laminated together preferably with heat-sealable surfaces front and back. Print may be sandwiched between the layers of film.

4. BOPP film of 10–35μm thickness laminated to LDPE or LLDPE film of 10–50 μm thickness. Combinations of LDPE and LLDPE in the film can be used and the addition of 2–10% ethylene vinyl acetate copolymer to the LDPE film can improve sealing.

5. 100% high density polyethylene film of 10–50 μm thickness surface printed and lacquered with the seal areas being free from ink and varnish.

Stiffener Materials

1. Cast films entirely (100%) of plastics material or cast films produced from plastics material filled with inert inorganic fillers or blowing agents to increase stiffness. Examples of this type of film are 50–250 μm polypropylene, polystyrene, acrylic/butadiene/styrene or PET. Fillers such as talc or clay may be present at 10–30%.

2. Boards coated both sides with 5–35 μm polyethylene. Combinations of LDPE and LLDPE can be used. Board quality is not critical with white lined chipboard, Duplex, Triplex or 100% bleached or unbleached Kraft boards being suitable in weights from 100–200 g/m$^2$.

The above respective wrapper and stiffener materials can be used in any combination with one another.

It is especially preferred that the wrapper system be entirely paper free.

Preferred embodiments of the invention will now be described with reference to the following Examples and accompanying graphical representation of weight loss due to loss of moisture during a period subsequent to wrapping of a freshly prepared soap bar.

EXAMPLES A TO H

The following wrapping systems were tested for fungicidal growth and weight loss.

| Example | Wrapper | Stiffener[3] | Sealing[4] |
|---|---|---|---|
| A | BOP[1] | Paper[5] | Part seal |
| B | BOP[1] | Paper[5] | No seal |
| C | BOP[1] | Paper[5] | Hermetic seal |
| D | BOP[1] | Plastic | Part seal |
| E | BOP[1] | Plastic | Hermetic seal |
| P | Paper[2 5] | Paper[5] | Part seal |
| G | Paper[2 5] | Paper[5] | No seal |
| H | Paper[2 5] | Paper[5] | Hermetic seal |

The above mentioned stiffness values were determined using a Digital Taber V-5 Stiffness Tester (model 150D) on ten samples each cut to a size of 40 mm×70 mm, five cut in the transverse and five in the machine direction. Before testing, the samples were preconditioned at 23° C./50% RH for twenty four hours. For the significance of the Taber Stiffness Units, see TAPPI Standard T489 om-86.

Each of the above wrappers and stiffeners was assessed for its resistance to fungicidal growth. The method of assessment was as follows.

As a medium for promoting the growth of moulds, a Sabouraud Dextrose Agar was employed. This consists of a mixture of mycological peptone (commercially available from Oxoid Ltd., England as Oxoid L40) (log), dextrose (40 g) and agar (15 g). This mixture is commercially available from Oxoid Ltd in powder (CM40) or table (CM42) form. For use, it is mixed with 1000 ml of distilled water and autoclaved for twenty minutes at 110° C. and cooled to give a growth medium having a pH of 5.6.

Small squares of test packaging material were cut using scissors dipped in alcohol, flamed and cooled. The squares were placed right side up and upside down onto the surface of poured petri dishes of Sabourauds dextrose agar using flamed, alcohol dipped tweezers.

Using a sterile pipette, 0.1 ml of mould inoculum (approximately $10^8$ spores $ml^{-1}$) were dispensed onto the centre of the square of packaging. Using a sterile plastic 'hockey stick', the inoculum was spread evenly over the surface of the agar and the packaging material.

The petri dishes were incubated at 28° C. for one week and the level of fungal growth on the packaging material and the agar assessed visually.

DESCRIPTION OF THE DRAWING

FIG. 1 is a graph depicting the weight loss (g) due to loss of moisture of freshly prepared sample bars of soap with the packaging systems of examples A to H.

The following key was used for the visual assessment.

0=no growth

10=slight growth

20=light, patchy growth

30=moderate growth over whole sample

40=heavy growth over most of sample

50=completely overgrown

As controls for comparison, Sabourauds dextrose agar without packaging materials and Sabourauds dextrose agar with preservative-free paper squares were included in the test. These plates showed a reading of 50, but each of the stiffness and wrappers in Examples A to H showed 0 (zero) fungal growth.

The results of these tests showed that when using wrappers and stiffeners of plastics material, zero fungal growth was achievable without the need for pretreatment with Carbendazim fungicide; contrast the stiffeners and wrappers of paper for which such pretreatment was necessary.

After wrapping respective freshly prepared sample bars of soap with the packaging systems of Examples A–H, the samples were stored at 37° C. and 70% RH and weighed regularly to determine the weight loss (g) due to loss of moisture. The results obtained are shown in FIG. 1.

As can be seen, those samples wrapped with a wrapper of plastics material suffered far less moisture loss over a period of 60 days than the samples wrapped with paper, even though the paper had been covered on respective sides with acrylic and wax coatings.

What is claimed is:

1. A bar of soap, comprising:

a stiffening member wrapped entirely around at least a longitudinal extent of said bar; said stiffening member including a stiff sheet material having a paper board core coated with a plastic material; and a wrapper surrounding said bar of soap and said stiffening member.

2. The bar of claim 1 where said paper board core is coated with a thermoplastic material to form outer layers.

3. The bar of claim 2 where said paper board core's outer thermoplastic layers each independently has a thickness in the range of 5 to 35 microns.

4. A mold resistant bar of soap, comprising:

a stiffening member wrapped entirely around at least a longitudinal extent of said bar; said stiffening member having respective outer surfaces of a thermoplastic material;

a wrapper surrounding said bar of soap and said stiffening member; and said stiffening member and said wrappers being fungicide free.

* * * * *